US008431878B2

(12) United States Patent
Dunn

(10) Patent No.: US 8,431,878 B2
(45) Date of Patent: Apr. 30, 2013

(54) HIGH TEMPERATURE FURNACE USING MICROWAVE ENERGY

(75) Inventor: Michael P. Dunn, Bourne, MA (US)

(73) Assignee: Novocamin Incorporated, Lockport, NY (US)

( * ) Notice: Subject to any disclaimer, the term of this patent is extended or adjusted under 35 U.S.C. 154(b) by 379 days.

(21) Appl. No.: 12/661,955

(22) Filed: Mar. 26, 2010

(65) Prior Publication Data

US 2010/0252550 A1 Oct. 7, 2010

Related U.S. Application Data

(60) Provisional application No. 61/258,870, filed on Nov. 6, 2009, provisional application No. 61/211,135, filed on Mar. 26, 2009.

(51) Int. Cl.
*H05B 6/64* (2006.01)

(52) U.S. Cl.
USPC ..... 219/759; 219/700; 219/712; 219/730

(58) Field of Classification Search ..... 219/684, 219/698, 700, 701, 710, 712, 716, 730, 749, 219/759
See application file for complete search history.

(56) References Cited

U.S. PATENT DOCUMENTS

| | | | | | |
|---|---|---|---|---|---|
| 4,013,477 | A * | 3/1977 | Jatkar et al. | ..... | 501/153 |
| 4,070,542 | A * | 1/1978 | Miles et al. | ..... | 373/150 |
| 4,138,455 | A * | 2/1979 | Shaikh et al. | ..... | 264/658 |
| 5,010,220 | A * | 4/1991 | Apte et al. | ..... | 219/686 |
| 5,580,433 | A * | 12/1996 | Baker et al. | ..... | 204/425 |
| 5,653,775 | A * | 8/1997 | Plovnick et al. | ..... | 51/309 |
| 6,066,290 | A * | 5/2000 | Dennis et al. | ..... | 419/38 |
| 6,365,885 | B1 * | 4/2002 | Roy et al. | ..... | 219/750 |
| 6,500,226 | B1 * | 12/2002 | Dennis | ..... | 75/240 |
| 6,512,216 | B2 * | 1/2003 | Gedevanishvili et al. | .... | 219/759 |
| 6,741,632 | B1 | 5/2004 | Dunn et al. | | |
| 6,768,089 | B2 * | 7/2004 | Minobe et al. | ..... | 219/699 |
| 2003/0209537 | A1 * | 11/2003 | Dalton | ..... | 219/634 |
| 2006/0016805 | A1 * | 1/2006 | Del Regno | ..... | 219/680 |
| 2006/0201936 | A1 * | 9/2006 | Agrawal et al. | ..... | 219/679 |

OTHER PUBLICATIONS

Subasri et al. ("Microwave assisted synthesis and sintering of La0.8Sr0.2Ga0.83Mg0.17O2.85", Mater. Lett. 57 (2003) 1792-1797).*
May et al. ("The effect of microstructure and phase composition on the ionic conductivity of magnesium-doped sodium-beta-alumina", J. Mater. Sci. 13 (1978) 1480-1486).*

* cited by examiner

*Primary Examiner* — William F Kraig
(74) *Attorney, Agent, or Firm* — Michael L. Dunn

(57) ABSTRACT

A microwave furnace that can operate at least 1700° C. having a furnacing chamber within a retaining cavity. The chamber is at least partly surrounded by microwave transparent insulation. At least one susceptor is at least partly between the insulation and the chamber. The susceptor at least in part is a specially formulated sintered coarse grain polycrystalline β alumina capable of absorbing microwave energy from room temperature to its maximum use temperature. The furnace has a power system providing microwave energy to activate the susceptor. A temperature sensor may be provided that has an infrared channeling tube to conduct an infrared signal from the chamber to a pyrometer for converting the infrared signal to an electrical signal proportional to temperature within the microwave chamber. The electrical signal is then used to signal the power supply to control temperature by controlling energy to the susceptor.

2 Claims, 5 Drawing Sheets

HIGH TEMPERATURE FURNACE USING MICROWAVE ENERGY

CROSS REFERENCE TO RELATED APPLICATIONS

This application claims the benefit under 35 U.S.C. §119 (e) of U.S. Provisional Application No. 61/211,135, filed Mar. 26, 2009 and U.S. Provisional Application No. 61/258,870, filed Nov. 6, 2009.

BACKGROUND OF THE INVENTION

High temperature furnaces for specialized applications requiring close temperature control are either not available or extremely expensive and difficult to produce. For precise temperature control a means for accurately measuring internal furnace temperature is required. Up to now, platinum thermocouples have been required for very high temperatures that can cost upwards of $4,000.

It would therefore be desirable to have a furnace that is less costly requiring sensors having lower temperature requirements.

Further, there has been some effort at using microwaves for high temperature furnaces. There has been a significant problem with this approach in that there have not been microwave susceptors available having a sufficiently low cost to make the idea practical. Microwave susceptors which are stable and capable of absorbing energy from room temperature to the maximum use temperature of this design without deteriorating or breaking and which can be produced in sizes large enough to provide a reasonable work space were previously unidentified.

In addition, it has been very difficult to process articles and materials in high temperature furnaces in a continuous operation. It is therefore an object of this invention to address problems associated with continuous high temperature furnaces as well as overcoming problems previously described.

BRIEF SUMMARY OF THE INVENTION

Figure 1:
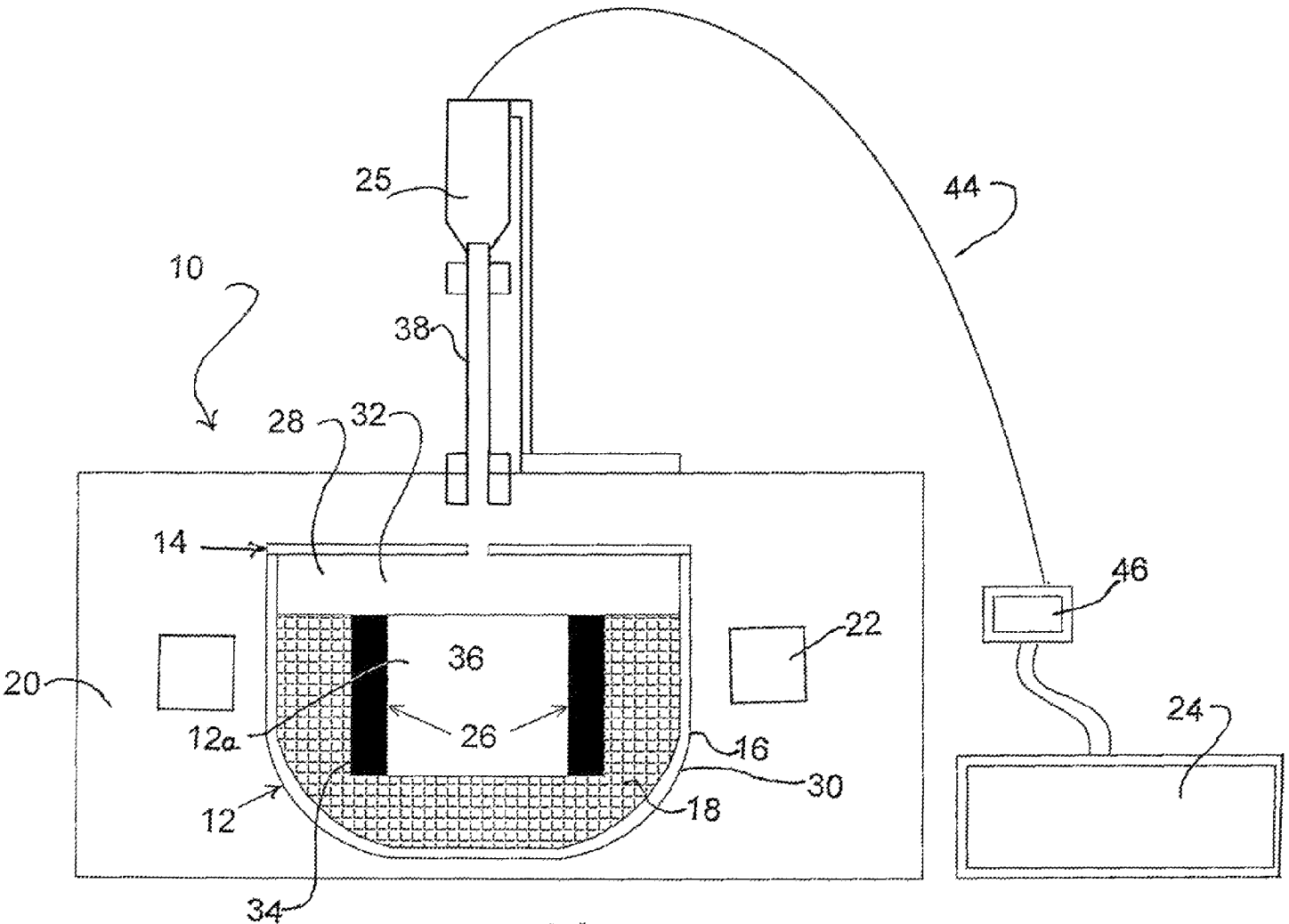
FIG. 1 shows a cross sectional elevational view of a bulk type microwave furnace of the invention

The invention, includes both batch type furnaces and continuous furnaces employing similar heating apparatus.

In particular the invention includes a microwave furnace having a furnacing chamber within a retaining cavity. The chamber is at least partly surrounded by microwave transparent insulation. At least one and preferably a plurality of microwave susceptors are provided located at least partly between the insulation and the chamber. The susceptor is at least partly and preferably almost entirely made coarse grain polycrystalline β alumina. This arrangement is similar in both batch type and continuous type furnaces At least one microwave power system is present for providing microwave energy to activate the susceptor.

The furnace preferably has a temperature sensor including a tube for transmitting infrared energy signal from the chamber to a pyrometer for converting the infrared signal to an electrical signal proportional to temperature within the microwave chamber.

The furnace further preferably includes a temperature controller that receives the electrical signal from the pyrometer and in turn provides an electrical signal to the power supply to control power of the microwave power system which in turn controls temperature based upon the infrared signal provided by the furnace chamber to the temperature sensor.

In accordance with the continuous furnace embodiment, continuous electromagnetic high temperature furnaces are provided that have the ability for continuous throughput and the ability to reach temperatures as high as 2000 degrees Celcius or higher.

The furnace includes a tunnel chamber having non-metallic electromagnetic susceptors proximate a heatable portion of the tunnel chamber. The suscepors being of β alumina, a source for electromagnetic radiation to be supplied to the susceptors in an area so that the susceptors are heated by the radiation which in turn heat the chamber, and apparatus for moving material to be heated in the furnace through the tunnel chamber.

In a preferred embodiment, for extremely high temperatures, the furnace includes a chamber, which in the case of a continuous furnace is a tunnel chamber, having non-metallic electromagnetic susceptors proximate a heatable portion of the chamber. The suscepors are of at least two types, a first of the types being primarily of gamma alumina oxide that acts as a susceptor at room temperature and a second of the types being of a material that acts as a susceptor at a temperature higher than room temperature and having a softening or decomposition temperature higher than the lowest of a softening or decomposition temperature of the first susceptor type, a source for electromagnetic radiation to be supplied in to the susceptors in an area so that the first susceptor type is heated by the radiation which in turn heats the second susceptor type to a temperature at which the second susceptor type becomes directly heated by the radiation and apparatus for removing the first susceptor type from the area thus permitting the second susceptor type to reach a temperature above the lowest of the softening or decomposition temperature of the first susceptor type without causing softening or decomposition of the first susceptor type and apparatus for moving material to be heated in the furnace through the tunnel chamber.

The temperature in the furnace may be tightly controlled by a temperature controller that receives a signal from an infrared thermocouple that sights the chamber and provides temperature related data to the temperature controller that in turn controls an electromagnetic radiation supply system. The electromagnetic radiation supply system is preferably a microwave power system.

DETAILED DESCRIPTION OF THE INVENTION

In a preferred embodiment of a batch type furnace, the microwave chamber is preferably a space defined by a quartz container having sidewalls with an internal surface at least partly surrounded by microwave transparent insulation and by the susceptor or a plurality of susceptors at least partly between the insulation and the chamber.

The microwave power system in both batch type and continuous type furnaces generally includes a power supply, a magnetron, a wave-guide launcher, a filament transformer, an isolator/circulator a coupler and an applicator.

The polycrystalline β alumina is preferably a coarse grain polycrystalline β alumina has an average grain size greater than 10 microns, more preferably greater than 30 microns and preferably less 150 microns.

A high temperature infrared transparent window may be interposed between the tube and the chamber. An example of such a window might be wholly or partly infrared transparent sapphire. The infrared conducting tube, may be sized and shaped to transfer sufficient infrared energy to the pyrometer for obtaining a signal from the pyrometer proportional to chamber temperature but small enough and of a material, e.g. a microwave absorbing metal, to prevent any significant, preferably essentially zero, microwaves from exiting.

The pyrometer used in accordance with the invention is an instrument for measuring relatively high temperatures, e.g. 1000 degrees C. and greater as may be found in high temperature furnaces or kilns. The preferred pyrometer used in accordance with the invention works by measuring radiation from the body whose temperature is to be measured. Such pyrometers are not required to actually contact the chamber or its contents. This is especially important in the context of the present invention since the extreme temperatures can adversely affect or even destroy a contact sensor such as a contact thermocouple unless such a thermocouple is made of a rare metals such as platinum or palladium or rhodium. Non-contact pyrometers may be in a number of forms, e.g. a solid state sensor or sensitive thermocouple. Solid state sensors generally contain a pyroelectric material, i.e. a material that provides an electrical current upon receipt of an infrared signal such as a thin film of gallium nitride, cesium nitrate, cobalt phthalocyanine or lithium tantalite. Remote infrared thermocouple sensors may be in the form of bimetallic pyroelectic thermocoupless. A example of a desirable remote sensing thermocouple is the EXERGEN™ IR t/c10A or 20A by Exergen Corporation in Watertown, Mass.

The temperature controller is computer programmable for a particular temperature. The temperature controller permits the temperature of the furnace to be precisely controlled (e.g. at an accuracy of ±5 degrees C. to ±100 degrees And preferably at an accuracy of at least ±50 degrees C. at temperatures above 1700 degrees Celsius.

The susceptor of the furnace is preferably made of beta alumina formulated for thermal shock resistance that enables rapid thermal cycling to a maximum use temperature. Preferably, the susceptor can reach 1700 degrees C. from room temperature in less than 30 minutes or can endure a greater than 50 degree C. per minute heat rate without cracking or degrading.

In a preferred embodiment of the bulk type furnace, the furnace permits the furnace chamber to be removed from the retaining cavity following a heating cycle and allowed to cool externally to the cavity and permits insertion of a second cold chamber into the cavity which can then be energized and heated to a desired temperature to maximize productivity.

The bulk type furnace of the invention may be better understood by reference to the drawing showing a preferred embodiment of the furnace of the invention wherein:

As best seen in FIG. 1 a furnace 10 is provided having a quartz crucible 12 having an internal chamber 12*a*, which crucible 12 has a body 16 and a lid 14. The chamber 12*a* contains microwave susceptors 26 separated from the body 16 by loose insulation 18, preferably in the form of alumina bubbles. The quartz crucible is contained within a microwave cavity 20 provided with microwave magnetrons 22 that provide microwaves to chamber 20 when energized by microwave power system 24.

The quartz crucible 12 is able to withstand high temperatures in excess of 1400° C. and is microwave transparent up to that temperature. Chamber 12*a* serves to contain economical loose insulation.

Crucible 12 has reasonable strength for handling. The handling ability allows for removal of the crucible following completion of a heating cycle. Cooling of the chamber is performed external to the microwave cavity allowing for the insertion of another chamber to begin another heating cycle. In this manner maximum productivity through the use of multiple chambers is afforded on one microwave system.

Preferably, both the quartz lid 14 and crucible are able to withstand the same high temperatures and maintain transparency to the microwave energy. The lid 14 provides containment and can be constructed in a manner to allow either for the introduction of a controlled atmosphere or to draw a vacuum.

Loose insulation 18 is preferably alumina bubble insulation but it is to be understood that other loose insulation such as zirconia bubbles or microwave transparent fiber board or mat can be used e.g. made of alumina fibers. Desired alumina bubble insulation remains microwave transparent throughout its useful temperature range.

Distance between the inside dimension of the chamber 12*a* and the outside dimension of the susceptor allows for greater than 1-½ inches of loose bubble insulation between the susceptors and wall 30 of the crucible. This is an extremely economical alternative to high temperature fiberboard insulations and provides greater flexibility in its configuration. This thickness has been determined to achieve an acceptable temperature drop allowing for the removal of the chamber by hand with special heat resistant gloves so the remainder of the cooling can be performed external to the microwave cavity.

Because of the expense of high temperature capable fiberboard, e.g. fiber board 28 as shown in the drawing, its use is preferably minimized in the design. As an insulating ceiling or insulating lid 32 for the chamber it helps provide for containment while being rigid enough to allow for handling so it can be removed providing access to the interior of the furnace chamber. The design allows for greater than 1-½" of board to provide a sufficient temperature drop again allowing for handling of the chamber and thermal protection for the interior of the microwave cavity.

The susceptor is a very coarse-grained polycrystalline alumina designed to withstand extremely rapid heating. This particular composition has been heat treated in such a manner to make the sintered structure susceptible to microwave energy from room temperature to near its melting point. Multiple experiments on small samples of this material have demonstrated its capability to reach temperatures in excess of 1700° C. Without deformation. In this particular design a cylinder 34 of this material is used which provides a furnace chamber of just over 4" diameter by 4" high. The flexibility in forming this material allows for furnaces constructed using flat plates and even larger cylinders.

A furnace chamber 36 is defined by the cylindrical susceptor that yields approximately a 4" inside diameter by 4" high heated space. Excellent uniformity is achieved with this continuous radiant surface completely surrounding the chamber.

A tube 38 is used to transmit infrared energy from the microwave cavity to an infrared sensor. The tube permits transmission of infrared energy from the chamber to the pyrometer but is designed to prevent escape of microwaves due to cross sectional size and/or material of construction, e.g. a microwave blocking metal. The sensing system is removable in order to facilitate the exchange of the heated chamber to a new cold chamber.

The use of the microwave channeling tube and pyrometer 25 is an extremely economical alternative to platinum sheathed, platinum rhodium thermocouples typically required for this environment at these temperatures. Due to the cost of platinum, alternatives are required to provide an economical system for the targeted markets. Depending upon the temperature range one IR responsive pyrometer may be sufficient for the entire range. If however, a higher temperature is required then using two sensors for the different ranges can be used by switching power control from a low temperature to a higher temperature pyrometer sensor at the appropriate temperature, temperature control can be maintained throughout the entire cycle.

The output from the pyrometer 25 is transmitted by electrical conductors 44 to a temperature controller 46. The electrical conductors may simply be inexpensive thermocouple wire. The output from the temperature controller provides input to the microwave power supply 24 which in turn activates the magnetrons 22 through wires 48 creating closed loop temperature control for the microwave furnace. The controller 46 is selected based on temperature range desired and programming capability such as the number of programs it can hold and the number of ramp soak segments each program can contain. Other features may include alarms, relays and communications capabilities.

The components of microwave power system typically include a microwave power supply 24, magnetron 22, and wave-guide launcher, filament transformer, isolator/circulator, coupler, and applicator within the power supply. A key feature is a CPU controlled power supply 24 allowing for closed loop temperature control. The furnace presently depicted in the sketches would require a power supply between 1-3 KW.

The microwave cavity can be constructed from a material such as aluminum to provide maximum efficiencies in the transfer of microwave energy. Alternatives may include stainless steel, which would reduce efficiency but may be necessary depending upon the application. The cavity is constructed from a sufficient gauge of material and with adequate support to hold the quartz vessel and all interior components. The size of the system described above and depicted in the sketch can fit within a commercial microwave oven. Preliminary tests were performed in an AMANA oven with 3 KW of maximum power.

Using the microwave furnace of the above described example, temperatures as high as 1800 degrees C. have been obtained.

For even higher temperatures, secondary susceptors may be used that are capable of functioning at the higher temperatures. Such susceptors may, for example, be made of zirconia, or conductive carbides, e.g. tantalum carbide. Secondary susceptors are often not functional at lower temperatures and thus must be brought to a higher temperature by primary susceptors after which the primary susceptors may be removed from the microwave field to prevent their destruction.

Figure 2:
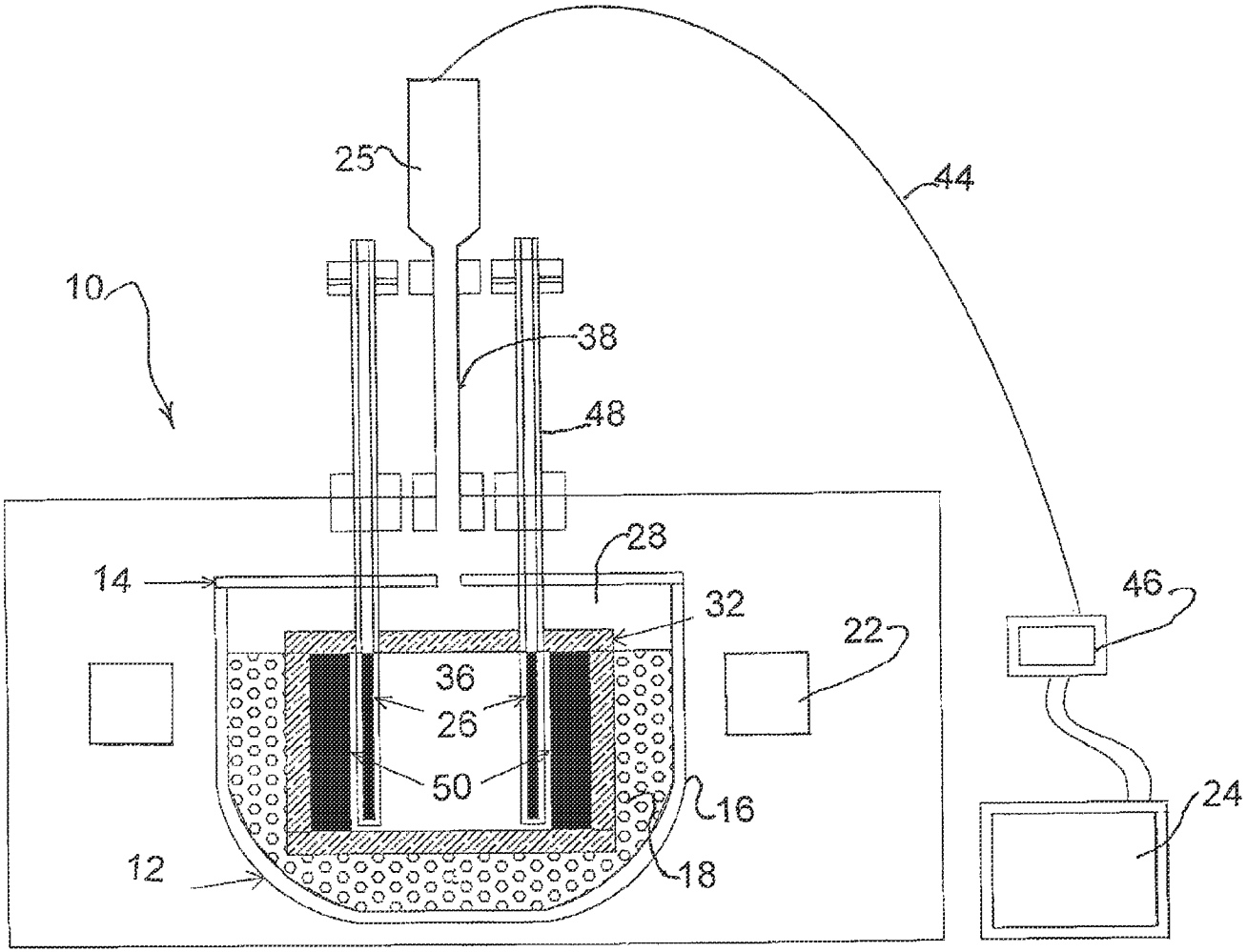
FIG. 2 shows a cross sectional elevational view of a bulk type furnace of the invention having secondary high temperature susceptors.

A bulk type microwave furnace utilizing secondary susceptors is illustrated in FIG. 2. The structure is similar to the furnace shown in FIG. 1 except that retractable alumina susceptors 26 are provided, e.g. within microwave transparent quartz tubes 48. The alumina susceptors are used to raised the temperature of the secondary susceptors 50 until they will heat the furnace in the absence of the primary susceptors. At that time the primary susceptors are removed. The secondary susceptors, in the case of zirconia secondary susceptors, can then heat the furnace to a temperature as high as 2000° C. Much higher temperatures can be obtained when high temperature carbides are used as secondary susceptors.

In the case of the continuous furnace, the furnace 10 is a furnace that can be operated continuously in that it is provided with a heating chamber in the form of a tunnel 11 through which material can be passed to be heated.

As in the bulk furnace embodiment, the material may be material in the form of particles from submicron size to several centimeters in longest dimension or may be in the form of larger units in the form of articles of essentially any shape.

The primary susceptors 26 are arranged in contact with or closely spaced, e.g. from less than a millimeter to about a centimeter, from at least a portion of the chamber. The susceptors are usually ceramic in nature and absorb the radiation and convert it to heat. Most such susceptors function at room temperature to their softening or decomposition temperature but some operate only at temperatures significantly above room temperature. Suitable susceptors that begin operation at room temperature are coarse grain polycrystalline beta alumina and high temperature carbides such as silicon carbide, tantalum carbide and tungsten carbide. An example of an ultra high temperature material that begins operation at a temperature significantly above room temperature is zirconium dioxide.

The furnace is provided with apparatus to cause material to pass through the tunnel.

In a preferred embodiment, the electromagnetic radiation is in the form of microwave radiation.

In such a case, a microwave power system is provided that powers a plurality of magnetrons about the chamber to provide a field of microwave energy. Temperature may be controlled by utilizing a thermocouple that can sight the chamber and send data or an analog signal related to temperature to a temperature controller that in turn controls output from a microwave power supply.

Otherwise stated, an infrared thermocouple, temperature controller, and electromagnetic radiation supply system are provided. The infrared thermocouple is arranged to sight the chamber and provide temperature related data to the temperature controller that in turn controls the electromagnetic radiation supply system.

In a preferred embodiment, the furnace includes a tunnel chamber having non-metallic electromagnetic susceptors proximate a heatable portion of the tunnel chamber. The suscepors may be of β alumina. A source for electromagnetic radiation is provided to supply the susceptors in an area so that the susceptors are heated by the radiation. The susceptors, in turn heat the chamber. Apparatus for moving material to be heated in the furnace through the tunnel chamber.

Desirably, at least some of the susceptors include β alumina which preferably is coarse grain polycrystalline β alumina.

Figure 3:
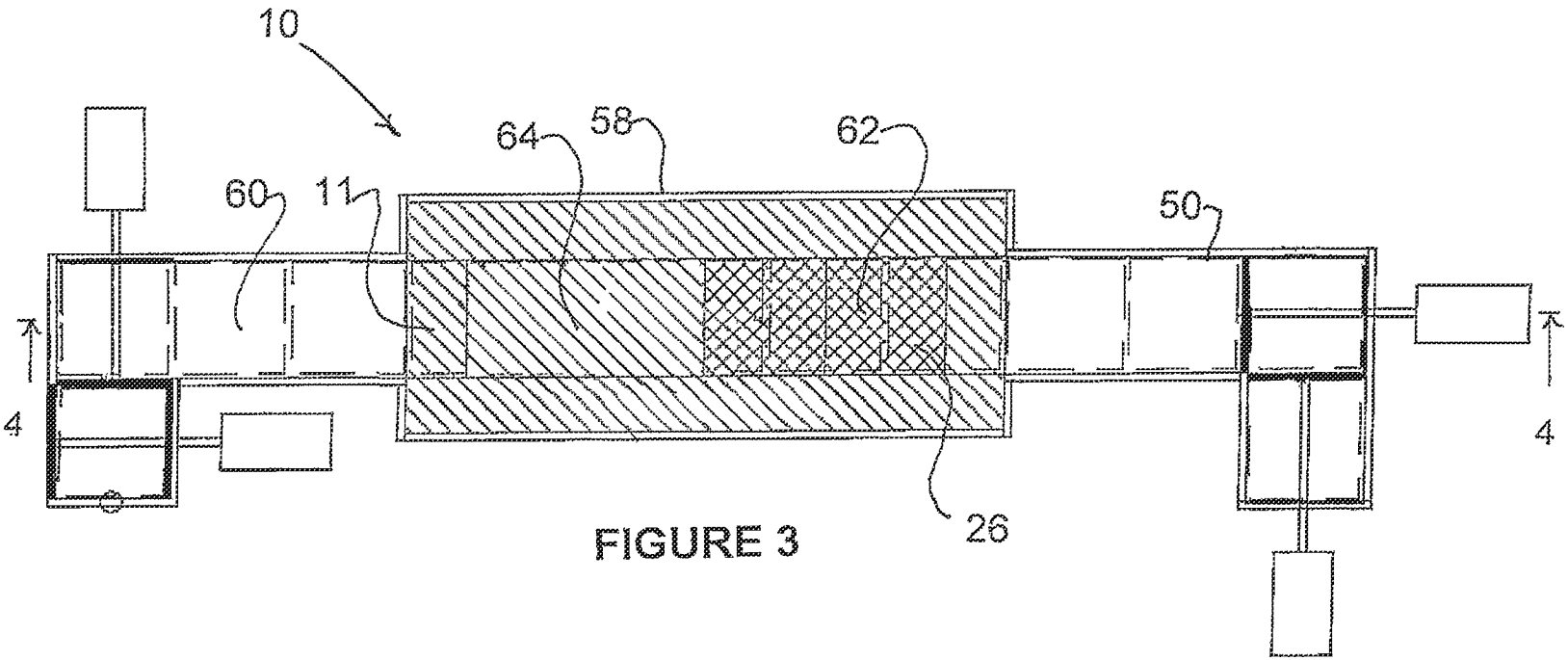
FIG. 3 shows a top cross sectional view of a continuous tunnel type microwave furnace of the invention taken on lines 3-3 of FIG. 4.
Figure 4:
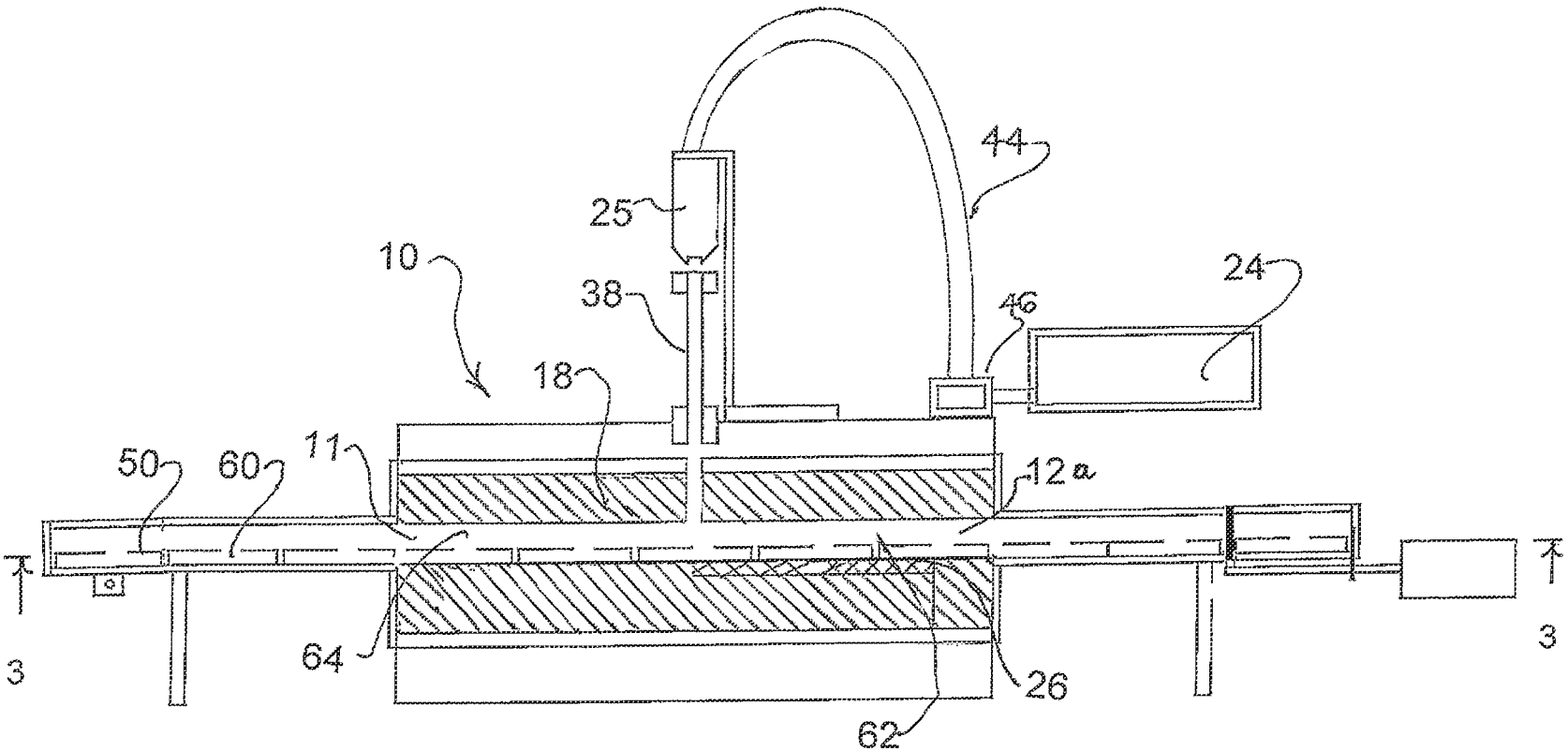
FIG. 4 shows an elevational cross sectional view of a continuous tunnel type microwave furnace of the invention taken on line 4-4 of FIG. 3.

The tunnel chamber may be rotatable or may be a fixed chamber having ceramic walls 58 as seen in FIGS. 3 and 4. In any case, apparatus is provided for conveying material through the chamber. Such an apparatus may be in the form of material carriers that are pushed through the chamber in series by pushing devices, e.g. retractable push rods.

In a specific preferred embodiment, the furnace includes a tunnel chamber having non-metallic electromagnetic susceptors proximate a heatable portion of the tunnel chamber.

The suscepors may be of at least two types. A first of the types are primarily of gamma aluminum oxide that acts as a susceptor at room temperature, i.e. primary susceptors, and a second of the types is of a material that acts as a susceptor at a temperature higher than room temperature and having a softening or decomposition temperature higher than the lowest of a softening or decomposition temperature of the first susceptor type, i.e. secondary susceptors.

A source is provided for electromagnetic radiation to be supplied to the susceptors so that the first susceptor type is heated by the radiation which in turn heats the second susceptor type to a temperature at which said second susceptor type becomes directly heated by the radiation and apparatus for removing the first susceptor type from the area thus permitting the second susceptor type to reach a temperature above the lowest of the softening or decomposition temperature of the first susceptor type without causing softening or decomposition of the first susceptor type and apparatus for moving material to be heated in the furnace through the tunnel chamber.

In one embodiment of the continuous, dual susceptor type furnace, a microwave zone contains stationary beta alumina susceptors on the floor of the kiln and a setter tile and/or pusher plate is made of ionically conductive zirconia. As the zirconia tile passes over the microwave suscepting alumina it heats to a point that it absorbs microwave energy and heats. When the zirconia plate is sufficiently that to become a susceptor, it passes into a second microwave zone where it can be heated by microwaves to temperatures as high as 2000° C. or more.

In another embodiment, the carriers 60 are made from secondary susceptor material such that when the carriers 60 pass over a heating zone containing primary suceptors, the secondary susceptors heat to suscepting temperature. They then pass into a microwave zone free from primary susceptors and the secondary susceptors, forming at least a part of the carrier 60, heat to extreme temperatures.

Figure 5:
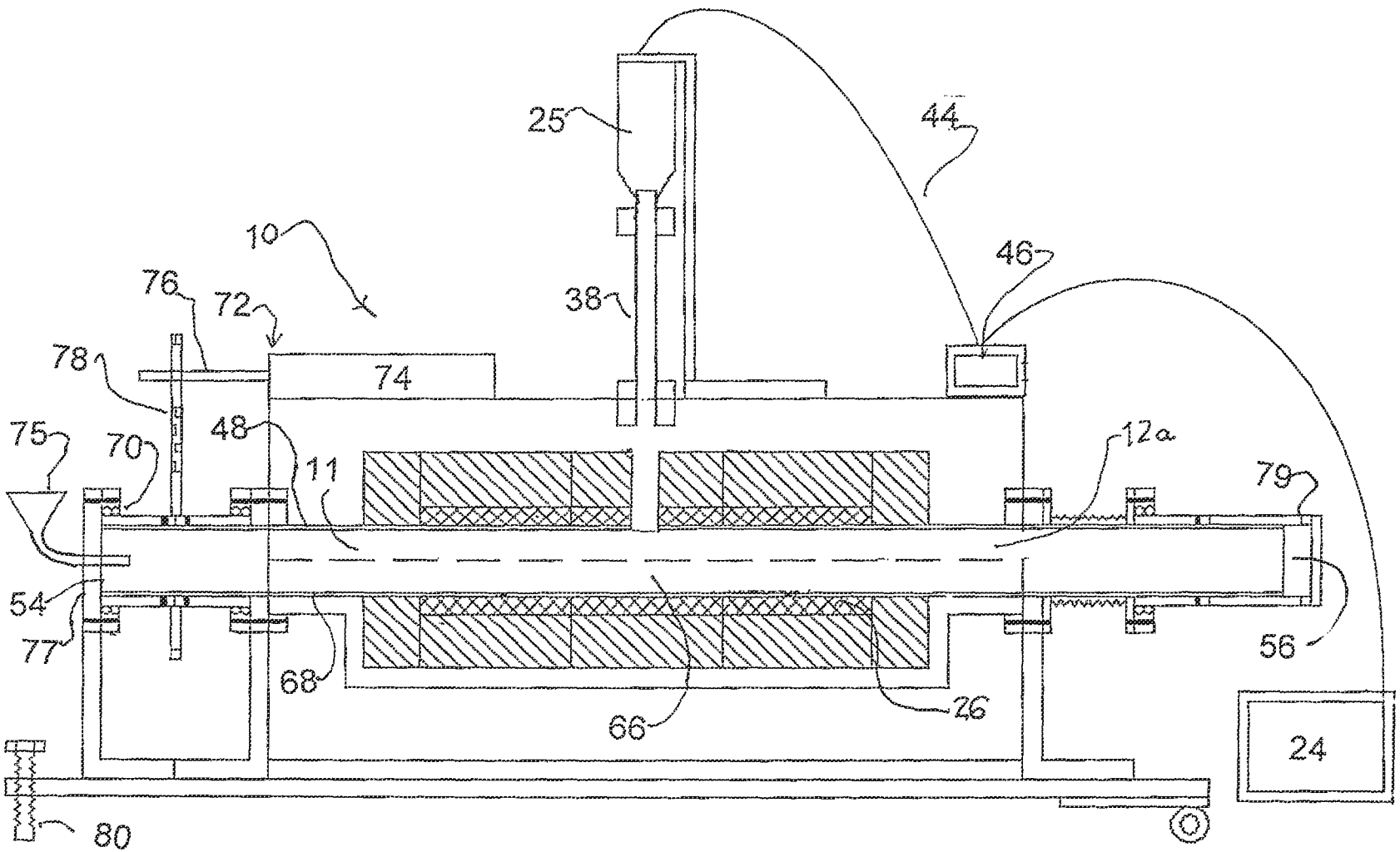
FIG. 5 shows an elevational cross sectional view of a continuous rotary type microwave furnace of the invention.

In yet another embodiment, An example of such an apparatus, as seen in FIG. 5, is a tunnel in the form of a rotatable ceramic tube 48 that is higher at an entrance end 54 and lower at an exit end 56 such that material passes from the entrance end to the exit end upon rotation of the tube. Such a tube may, for example, be formed of zirconia.

Non-metallic electromagnetic susceptors 26 are provided about the rotatable ceramic tube 48 proximate a heatable portion 66 of the tunnel chamber 12*a*. The suscepors 26 are desirably of β alumina. A microwave power source 24 is provided as a source for electromagnetic radiation to be supplied to the susceptors 26 in an area so that the susceptors 26 are heated by the radiation which in turn heat the chamber 12*a*. The microwave power source is controlled by temperature controller 46 that in turn operates in response to a signal provided by infrared thermocouple 25 that provides the signal in response to observation through sight tube 38 to wall 68 of rotatable tube 48

In heatable portion 66 rotatable tube 48*s* surrounded by insulating ceramic blocks 70 which are desirably zirconia blocks.

Rotatable tube 48 journaled in bearings 70 and rotated by drive mechanism 72 including motor 74, shaft 76 and belt 78. Apparatus 80 in the form of adjustable leveling bolts is provided for increasing or decreasing slope to increase or reduce speed through the tunnel by raising or lowering the input end 54 of the tunnel chamber 12*a*, respectively. Closures 77 and 79 are provided at input end 54 and output end 56 of the tunnel chamber 12*a* to retain heat in the chamber when input end 54 or output end 56 does not have to be opened to insert or remove material of for cleaning purposes. In the case of supplying powder or other relatively small particulate material to the tunnel chamber, a funnel arrangement 75 may be provided.

What is claimed is:

1. A microwave furnace comprising:

a furnacing chamber within a retaining cavity, said chamber being at least partly surrounded by microwave transparent insulation;

at least one susceptor at least partly between the insulation and the chamber, said susceptor comprising coarse grain polycrystalline β alumina wherein said susceptors are of at least two types, a first of said types being a primary susceptor acting as a susceptor at room temperature and a second of said types being a secondary susceptor of a material that acts as a susceptor at a temperature higher than room temperature and having a softening or decomposition temperature higher than the lowest of a softening or decomposition temperature of said first susceptor type, a source for electromagnetic radiation to be supplied in to said susceptors in an area so that said first susceptor type is heated by said radiation which in turn heats said second susceptor type to a temperature at which said second susceptor type becomes directly heated by said radiation and apparatus for removing the first susceptor type from said area thus permitting said second susceptor type to reach a temperature above the lowest of the softening or decomposition temperature of the first susceptor type without causing softening or decomposition of the first susceptor type and apparatus for moving material to be heated in the furnace through the furnacing chamber in the form of a tunnel chamber.

2. A furnace comprising a tunnel chamber having non-metallic microwave susceptors proximate a heatable portion of said tunnel chamber, a source for electromagnetic radiation to be supplied to said susceptors in an area so that said susceptors are heated by said radiation which in turn heat said chamber, and apparatus for moving material to be heated in the furnace through the tunnel chamber wherein the tunnel chamber has non-metallic electromagnetic susceptors proximate the heatable portion of said tunnel chamber, said susceptors being of at least two types, a first of said types being a primary susceptor acting as a susceptor at room temperature and a second of said types being a secondary susceptor of a material that acts as a susceptor at a temperature higher than room temperature and having a softening or decomposition temperature higher than the lowest of a softening or decomposition temperature of said first susceptor type, a source for electromagnetic radiation to be supplied in to said susceptors in an area so that said first susceptor type is heated by said radiation which in turn heats said second susceptor type to a temperature at which said second susceptor type becomes directly heated by said radiation and apparatus for removing the first susceptor type from said area thus permitting said second susceptor type to reach a temperature above the lowest of the softening or decomposition temperature of the first susceptor type without causing softening or decomposition of the first susceptor type and apparatus for moving material to be heated in the furnace through the tunnel chamber.

* * * * *